US007056086B2

(12) United States Patent
Hassan

(10) Patent No.: US 7,056,086 B2
(45) Date of Patent: Jun. 6, 2006

(54) STEAM TURBINE INCLUDING A HIGH-PRESSURE BODY HAVING A SINGLE STATE OF BLADES

(75) Inventor: Alain Hassan, Paris (FR)

(73) Assignee: ALSTOM Technology Ltd, Baden (CH)

( * ) Notice: Subject to any disclaimer, the term of this patent is extended or adjusted under 35 U.S.C. 154(b) by 79 days.

(21) Appl. No.: 10/823,016

(22) Filed: Apr. 13, 2004

(65) Prior Publication Data

US 2004/0219012 A1 Nov. 4, 2004

(30) Foreign Application Priority Data

Apr. 17, 2003 (FR) ..... 03 04815

(51) Int. Cl.
*F01D 9/02* (2006.01)

(52) U.S. Cl. ..... 415/122.1; 415/199.4

(58) Field of Classification Search ..... 415/199.4, 415/199.5, 181, 229, 122.1; 416/170 R
See application file for complete search history.

(56) References Cited

U.S. PATENT DOCUMENTS

| | | | | |
|---|---|---|---|---|
| 1,494,850 | A | 5/1924 | Losel | |
| 1,925,147 | A | 9/1933 | Lysholm | |
| 2,861,776 | A | 11/1958 | Magill | |
| 3,185,854 | A * | 5/1965 | Hoffman | 290/52 |
| 3,804,335 | A * | 4/1974 | Sohre | 239/289 |
| 4,150,918 | A * | 4/1979 | Theis, Jr. | 415/202 |
| 4,189,813 | A * | 2/1980 | Ostermann et al. | 29/889.2 |
| 4,815,931 | A | 3/1989 | Linck et al. | |
| 5,274,997 | A * | 1/1994 | Inoue et al. | 60/39.511 |
| 5,511,949 | A | 4/1996 | Thore | |

FOREIGN PATENT DOCUMENTS

| | | |
|---|---|---|
| DE | 299 02 285 | 5/1999 |
| FR | 726445 | 5/1932 |
| FR | 980726 | 5/1951 |
| FR | 1159936 | 7/1958 |
| GB | 191360 | 5/1923 |
| GB | 1 010 300 | 11/1965 |
| GB | 1 572 934 | 8/1980 |

OTHER PUBLICATIONS

Rapport de Recherche Preliminaire—FR 0304815—2 Pgs.

* cited by examiner

*Primary Examiner*—Ninh H. Nguyen
(74) *Attorney, Agent, or Firm*—Arthur E. Fournier, Jr.

(57) ABSTRACT

A steam turbine 1 constructed in accordance with the present invention comprises a high-pressure module 2 and a low-pressure module 3, a speed-reducing gearbox 4, and an alternator, and wherein the high-pressure module 2 has a single stage of blades 20. This single stage of blades 20 performs the same function as a multi-stage high-pressure module, but with a blade design that is different from the blade design of multi-stage steam turbines. For example, the pressure ratio between the inlet and the outlet of the high-pressure module 2 may be in the range 3 to 20.

18 Claims, 3 Drawing Sheets

STEAM TURBINE INCLUDING A HIGH-PRESSURE BODY HAVING A SINGLE STATE OF BLADES

The present invention relates to steam turbines, and more particularly to steam turbines that include a high-pressure body or module and a low-pressure body or module.

BACKGROUND OF THE INVENTION

The high-pressure module of a steam turbine includes a rotor of about five to ten stages, with an equal number of rows of stationary blades and of moving blades.

That type of high-pressure module of a steam turbine is complex to manufacture and to assemble, and its cost is therefore high.

SUMMARY OF THE INVENTION

An object of the invention is to provide a high-pressure module of a steam turbine that is simple to manufacture and to assemble, while also having a low cost.

A steam turbine in accordance with the present invention comprises a high-pressure module having a single stage of blades, a low-pressure module, a speed-reducing gearbox, and an alternator, wherein the high-pressure module thereof has a one-piece nozzle. Such a high-pressure module having a single stage performs the same function as a multi-stage high-pressure module of a steam turbine, but with a blade design that is different from the blade design of multi-stage steam turbines, and it is easier and less costly to make. For example, the pressure ratio between the inlet and the outlet of such a high-pressure module may be in the range 3 to 20.

According to another object of the present invention, each module of a steam turbine includes a rotor and the rotor of such a high-pressure module and the rotor of the low-pressure module are driven by the speed-reducing gearbox.

According to a particular object of the present invention, the stationary blades, i.e., the nozzles of such a high-pressure module of a steam turbine are of a profile provided with channels that converge and then diverge going from the inlet to the outlet of such a high-pressure module. This profile for the stationary blades, which may also be known as "nozzles", is established on the basis of supersonic flow theory. Each such stationary blade has a profile such that it limits separation and losses along the channels, and this profile is established by using complex calculations in three dimensions and by using aerodynamics equations.

According to another particular object of the present invention, such a high-pressure module of a steam turbine embodies the shape of a converging-diverging nozzle. Such a shape is characteristic of supersonic flows because aerodynamics equations applied to supersonic flows show the need to have channels whose cross-section varies by converging and then diverging.

According to yet another object of the present invention, such a high-pressure module of a steam turbine includes a moving wheel that is constrained to rotate with a shaft and that supports the blades, all of these elements comprising a one-piece unit. In other words, the blades are machined in the same piece as the shaft. Making these elements as a one-piece unit simplifies both the manufacture thereof and the assembly thereof.

According to an additional object of the present invention, the shaft is coupled to a speed-reducing gearbox. This speed-reducing gearbox has three shafts; namely, two high-speed shafts for such a high-pressure module and for the low-pressure module, respectively, and a low-speed shaft for the alternator. The shaft of such a high-pressure module is connected to one of the high-speed shafts of the speed-reducing gearbox.

According to yet another particular object of the present invention, the shaft of such a high-pressure module is connected directly to the speed-reducing gearbox. Conventionally, such a shaft is coupled to the gearbox via an intermediate component, whereas, in accordance with the present invention, such a shaft is coupled to the speed-reducing gearbox directly. Thus, a saving of one component is realized, which makes it possible to simplify and to reduce the cost of the entire assembly.

According to yet another object of the present invention, such a high-pressure module of a steam turbine is provided with a single steam adjustment valve, which simplifies such a high-pressure module.

According to yet another object of the present invention, such a high-pressure module is provided with an independent bearing. Such an independent bearing is placed in such a high-pressure module of a steam turbine, in the vicinity of the speed-reducing gearbox.

BRIEF DESCRIPTION OF THE DRAWINGS

The invention will be better understood on reading the following description given merely by way of example and with reference to the accompanying drawings, in which.

DETAILED DESCRIPTION OF THE PREFERRED EMBODIMENT

Figure 1:
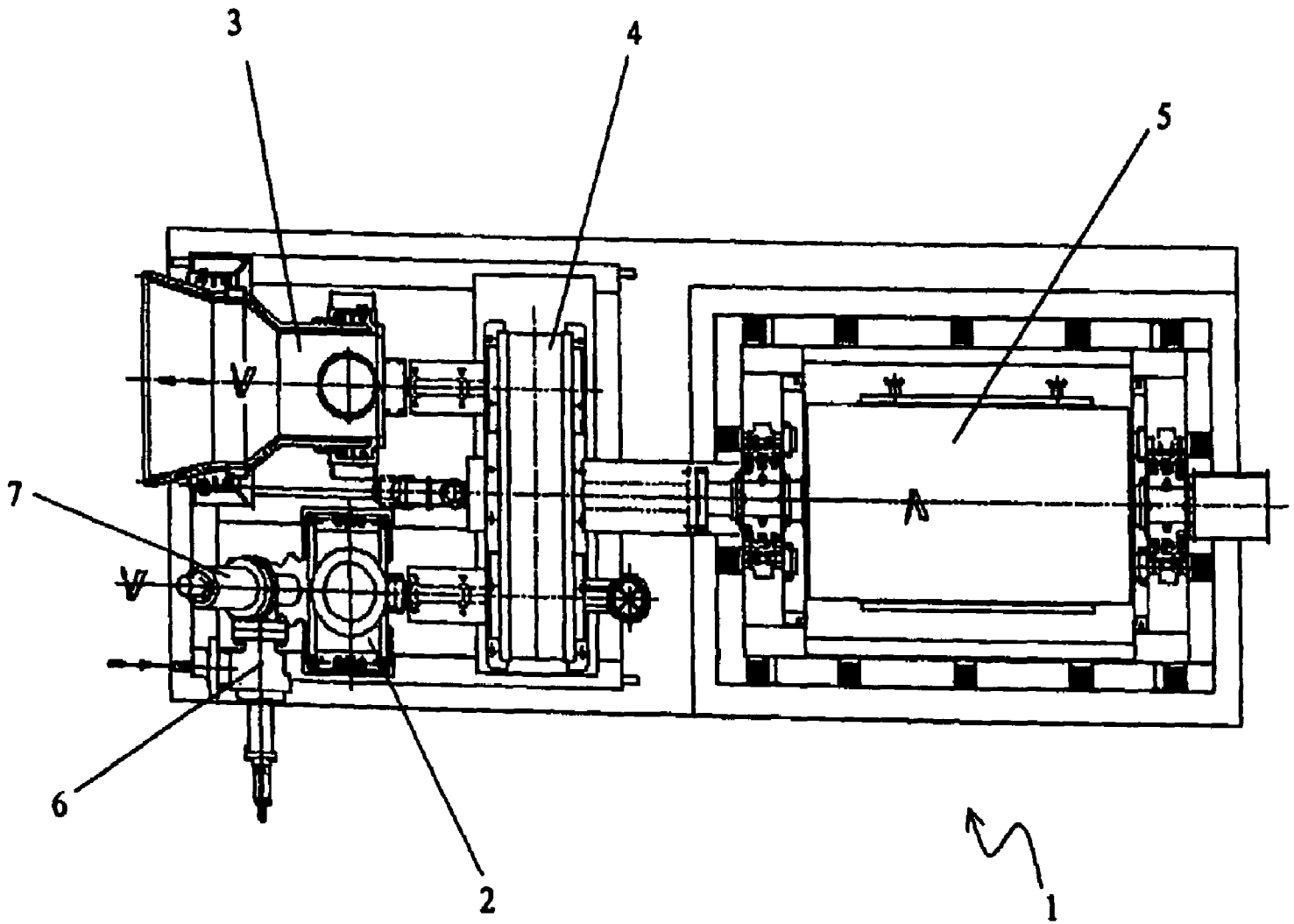
FIGURE 1 (PRIOR ART)
FIG. 1 is an overall view of a prior art steam turbine.

As shown in FIG. 1, the prior art steam turbine 1 comprises two bodies, namely a high-pressure module 2 and a low-pressure module 3, a speed-reducing gearbox 4, and an alternator 5. Steam enters the steam turbine 1 via an inlet unit including a stop valve 6 and four adjustment valves 7. In accordance with FIG. 1, the high-pressure module 2 is connected to the speed-reducing gearbox 4 via a flexible coupling.

Figure 2:
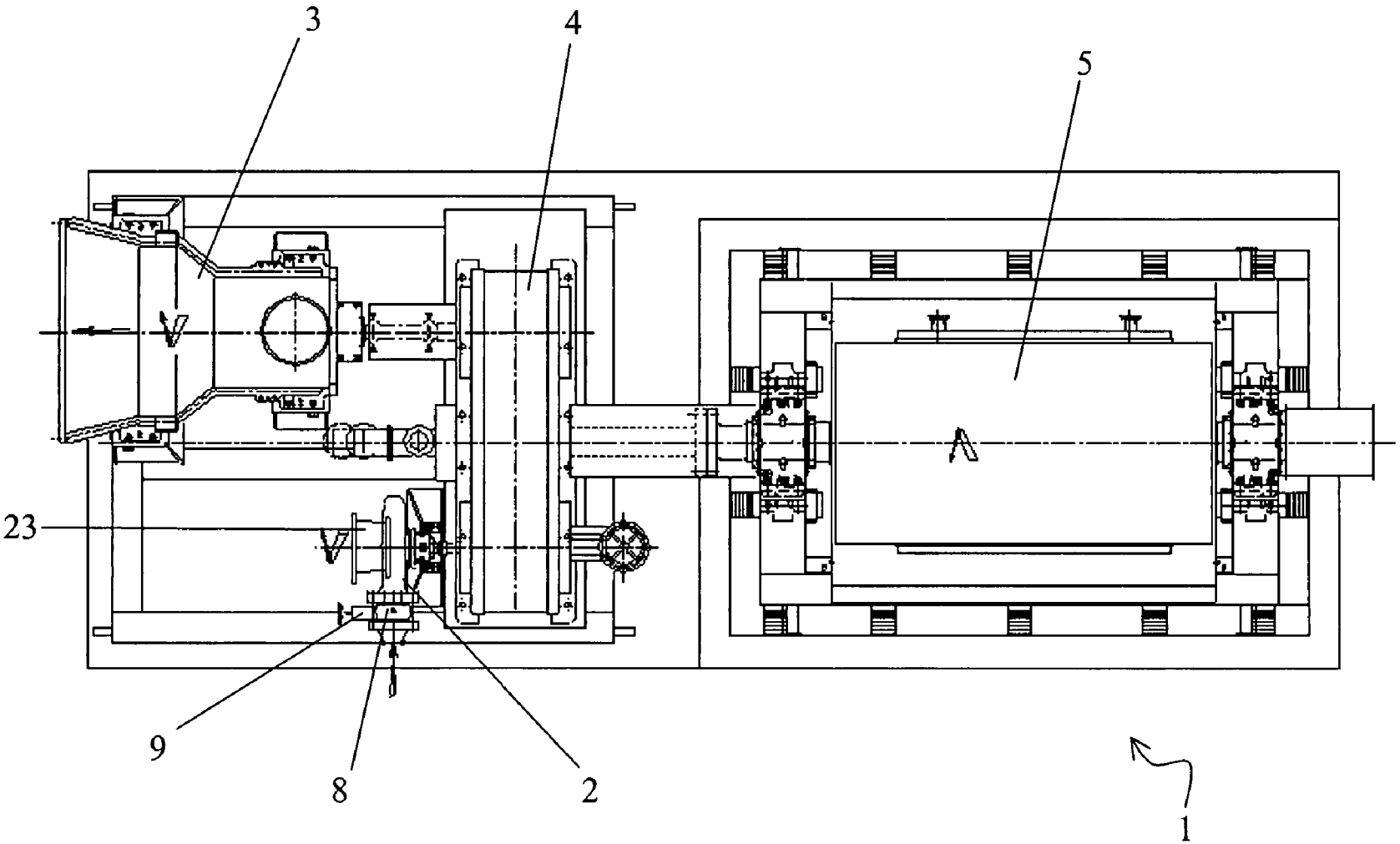
FIG. 2 is an overall view of a steam turbine constructed in accordance with the present invention.

The steam turbine 1 of the present invention includes the same elements as in the prior art, except that the high-pressure module 2 of the steam turbine 1 constructed in accordance with the present invention is much smaller in size (see FIG. 2).

Figure 3:
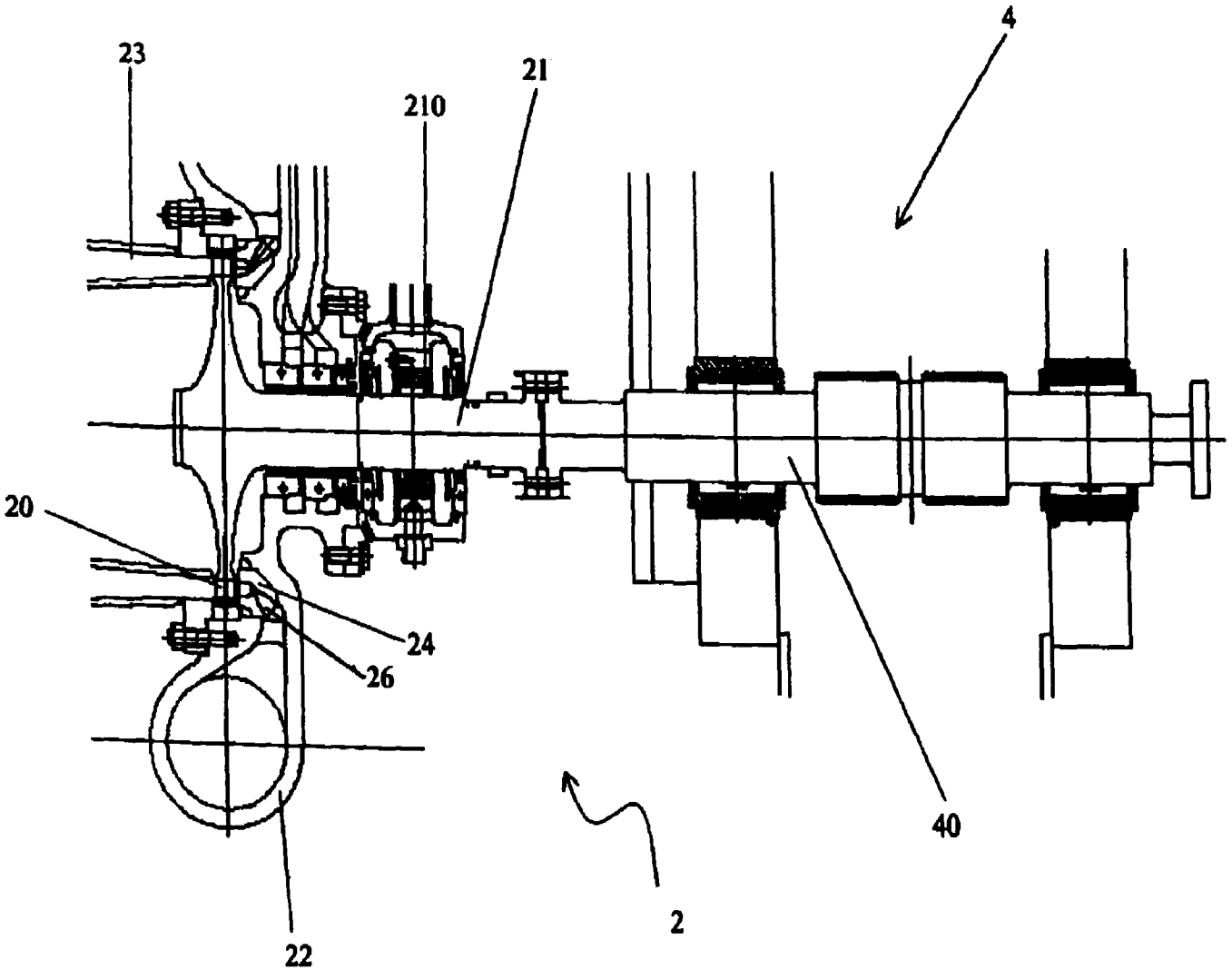
FIG. 3 is a fragmentary section view of the high-pressure module, constructed in accordance with the invention, of a steam turbine.

Looking in detail in FIG. 3 at the high-pressure module 2 of the steam turbine 1 constructed in accordance with the present invention, it can be seen that the single stage of blades 20 is mounted on the shaft 21. The shaft 21 is supported by a bearing 210 that is disposed in the vicinity of the speed-reducing gearbox 4. The shaft 21 is connected directly to the shaft 40 of the gearbox 4. The shaft 21 is driven by a rotor (not shown). The speed-reducing gearbox 4 also drives as well the rotor (not shown) of the low-pressure module 3.

With further reference to FIG. 3, the steam enters the high-pressure module 2 of the steam turbine 1 constructed in accordance with the present invention via an inlet volute 22, which directs the steam onto the blades 20. The steam then exits via a diffuser 23, which diverges in the direction from its inlet end to its outlet end, thus serving to reduce the output speed of such steam.

The stationary blades, i.e., the nozzles 24 of the high-pressure module 2, are of a profile provided with channels 26 that converge and then diverge going from the inlet to the outlet of the high-pressure module 2. This profile for the nozzles 24 is established on the basis of supersonic flow theory.

The spiral shape of the inlet volute 22 makes it possible to generate a uniform flow at the inlet end of the supersonic nozzle 24 at all azimuth angles.

The supersonic nozzle 24 may be a multi-channel nozzle. The steam can then enter the body via a multitude of openings.

The steam flow rate is adjusted by an adjustment valve 8.

The steam flow can be stopped by a stop valve 9.

While the invention has been illustrated and described as embodied in a specific embodiment, it is not intended to be limited to the details shown, since various modifications and structural changes may be made without departing in any way from the spirit of the present invention.

What is claimed is:

1. A steam turbine comprising: a high-pressure module including a single stage of blades, a low-pressure module, a speed-reducing gearbox, and an alternator, wherein said high-pressure module has a one-piece nozzle and said high-pressure module is provided with a single steam adjustment valve.

2. The steam turbine according to claim 1 wherein each of said high-pressure module and of said low-pressure module includes a rotor and wherein said rotor of said high-pressure module and said rotor of said low-pressure module is driven by said speed-reducing gearbox.

3. The steam turbine according to claim 1 wherein said one-piece nozzle includes a channel that converges and then diverges in the direction from the inlet to the outlet thereof.

4. The steam turbine according to claim 3 wherein said one-piece nozzle is a multi-channel nozzle.

5. The steam turbine according to claim 1 wherein said high-pressure module includes a moving wheel that is constrained to rotate with a shaft and that supports said blades and wherein said moving wheel and said shaft comprise a one-piece unit.

6. The steam turbine according to claim 5 wherein said shaft is coupled to said speed-reducing gearbox.

7. The steam turbine according to claim 6 wherein said shaft is connected directly to said speed-reducing gearbox.

8. The steam turbine according to claim 1 wherein said high-pressure module is provided with an independent bearing.

9. A steam turbine comprising:

an alternator;

a speed-reducing gearbox coupled to said alternator by a low-speed shaft;

a low pressure module coupled to said speed-reducing gearbox by a first high-speed shaft; and a high-pressure module coupled to said speed-reducing gearbox by a second high-speed shaft, wherein said high-pressure module includes:

a single stage of blades, a moving wheel that is constrained to rotate with the second high-speed shaft and that supports said blades, a one-piece nozzle; and a single steam adjustment valve that adjusts a flow rate of the steam to the one-piece nozzle and the blades.

10. The steam turbine according to claim 9 wherein the one-piece nozzle has a profile that includes channels that converge and then diverge in the direction from the inlet to the outlet thereof.

11. The steam turbine according to claim 9 wherein said moving wheel is attached to a high-pressure module shaft, and said high-pressure module shaft is coupled to said second high-speed shaft.

12. The steam turbine according to claim 9 wherein said moving wheel and said high-pressure module shaft comprise a one-piece unit.

13. The steam turbine according to claim 12 wherein said shaft is connected directly to said speed-reducing gearbox.

14. The steam turbine according to claim 9 wherein said high-pressure module is provided with an independent bearing.

15. A high-pressure module for a steam turbine, the high-pressure module comprising:

a shaft;

a single stage of blades;

a moving wheel chat is constrained to rotate with the shaft and that supports said blades;

a one-piece nozzle; and a single steam adjustment valve that adjusts a flow rate of the steam to the one-piece nozzle and the blades.

16. The high-pressure module according to claim 15 wherein the one-piece nozzle has a profile that includes channels that converge and then diverge in the direction from the inlet to the outlet thereof.

17. The high-pressure module according to claim 9 wherein said moving wheel and said shaft comprise a one-piece unit.

18. The high-pressure module according to claim 15 further comprising a bearing that supports said shaft.

* * * * *